US005769020A

United States Patent [19]

Shields

[11] Patent Number: 5,769,020

[45] Date of Patent: Jun. 23, 1998

[54] SYSTEM AND METHOD FOR STABILIZING MULTIPLE FLATFORMS ONBOARD A VESSEL

[75] Inventor: Steven E. Shields, San Diego, Calif.

[73] Assignee: Raytheon Company, Los Angeles, Calif.

[21] Appl. No.: 876,990

[22] Filed: Jun. 16, 1997

[51] Int. Cl.[6] ..... B63B 9/08

[52] U.S. Cl. ..... 114/121

[58] Field of Search ..... 114/343, 121, 114/122, 123, 124, 125, 126, 264, 265, 258

[56] References Cited

U.S. PATENT DOCUMENTS

| | | | |
|---|---|---|---|
| 4,898,288 | 2/1990 | Erdbrink | 114/121 |
| 4,926,778 | 5/1990 | Johnston | 114/121 |
| 5,586,512 | 12/1996 | Orbeck | 114/121 |

OTHER PUBLICATIONS

"KVH's Actively Stabilized Antenna Pedestals (ASAP)", KVH Industries, Inc., Middletown, Rhode Island.

*Primary Examiner*—Stephen Avila

*Attorney, Agent, or Firm*—David W. Collins; Leonard A. Alkov; Glenn H. Lenzen, Jr.

[57] ABSTRACT

Platforms on a vessel in motion are stabilized relative to one another and relative to the vessel. Primary sensors sense the position and orientation of the vessel's center of mass, which it uses as a common reference. Secondary sensors sense local platform motion to compensate for positional variations due to the vessel flexing or other localized motion. A computational system processes secondary position information relative to the common reference and calculates adjustments required to stabilize the localized platforms. By using secondary sensors in conjunction with the primary sensors, the platforms are stabilized in real time without accumulation of position error over time and are capable of being synchronized to each other.

10 Claims, 3 Drawing Sheets

SYSTEM AND METHOD FOR STABILIZING MULTIPLE FLATFORMS ONBOARD A VESSEL

BACKGROUND OF THE INVENTION

1. Field of the Invention

This invention relates to a system for stabilizing platforms on a moving vessel, and more particularly to stabilizing multiple platforms with respect to a common reference and compensating for local platform motion.

2. Description of the Related Art

Vessels having antennas for radar capabilities, reception of satellite television and telephone service, or other systems requiring antenna reception rely on platforms to stabilize the antenna while the vessel is in motion. Uninterrupted reception requires the antenna on the vessel be kept in alignment with the broadcast satellite. The shipboard antennas are mounted on platforms, or pedestals, which are continuously and automatically stabilized to maintain antenna alignment. The stabilizing system determines the position of the platform relative to a reference, such as true north or a planet. The position of the satellite relative to the same reference is known. Using the satellite and platform positions, adjustments required to maintain alignment are calculated.

One known system, such as the ASAP 19, ASAP 25 and ASAP 33 stabilized antenna pedestal produced by KVH Industries, Inc., Middletown, R.I., stabilizes each platform in response to motion sensed at the platform relative to a local reference point. A series of sensors are positioned within each platform and a robotic arm is used to stabilize the position of the platform. The sensors detect changes in platform position relative to a reference, such as a true north heading or the horizon. Changes in position are processed in real time, and using a robotic arm, the antenna's position is adjusted for relatively uninterrupted reception. Stabilizing the platform's position relative to its alignment with the reference, rather than the vessel, degrades performance. Errors in position are not corrected, but instead accumulate over a period of time cause the antenna position to drift and become misaligned with the satellite. Furthermore, the multiple platforms are not aligned with respect to each other. Each stabilization system adjusts its platform relative to its own reference point. Independent stabilization will produce different position errors on the multiple platforms.

Another known system adjusts the platform with respect to the vessel's center of mass. Sensors in the hull of the vessel detect changes in position. The sensor information is processed to determine the location, position and angle of the vessel. Position and angle information, such as pitch and roll, are then used to stabilize platforms with respect to the vessel's center of mass. The system uses latitude, longitude, velocity north and velocity east to initiate and maintain antenna alignment with the orbiting satellite. A computer processes the information and predicts the vessel's position at a time in the future. The antenna platforms are then positioned based upon the prediction. The process of calculating ahead is used to compensate for the time delay associated with sensing positional changes, processing the sensor information and distributing the positioning information to multiple locations.

This approach adjusts the platforms as though they are located at the vessel's center of mass, which is not true. On most vessels, the platforms are located some distance from the center of mass. The system does not account for variations in pitch and roll which might occur at different locations on the vessel. On a large vessel, different sections of the vessel will have measurably different positions with respect to the center of mass. For example, as the vessel travels through the water, the vessel's forward section may be subject to the rise of a wave before the aft section. Or, an antenna may be mounted on a mast which may have a different position due to bending. If the vessel has two platforms, one aft and one forward, each is in a different position with respect to each other and with respect to the vessel's center of mass. Stabilizing the position of each platform using the center of mass as a reference, fails to keep the two antennas aligned with respect to each other.

The unavoidable transmission delay associated with the centralized approach is also a problem. Because the sensors are positioned at the vessel's center of mass and the platforms are distributed throughout the vessel, the positioning information is not available for stabilizing the platforms in real time. To compensate for the time delay, the system predicts an estimated position and orientation at a time ahead. Calculating ahead is inferior to real time measurement and tends to destabilize the platforms.

Neither known stabilization system aligns a vessel's multiple platforms with respect to a common reference while taking into consideration local positioning variations. In the case of independently aligned antennas, the problem is drifting over time producing platform-to-platform errors. For systems having more than one antenna tracking the same location, the errors lead to aiming variations as between a radar system and the weapon relying on that radar for targeting. Systems that use the center of mass as a reference, fail to compensate for variations in pitch and roll that occur from platform-to-platform, which may also cause aiming variations.

SUMMARY OF THE INVENTION

The present invention provides a real-time stabilization system which reduces positioning errors accumulated over time and improves platform-to-platform synchronization. This is accomplished by generating a common reference from primary sensor data and sensing the local platform motion using secondary motion sensors at each platform location to stabilize the platform. By using secondary sensors in conjunction with the primary sensors, the platforms are stabilized in real time with respect to the common reference while taking into consideration local platform motion. The common reference provides a way to synchronize multiple platforms to ensure that they are all tracking the same location.

In one embodiment, primary sensors positioned within the hull of the vessel sense changes in position resulting from the vessel's motion. A primary computer converts this information to digital data which is processed to determine the position and orientation of the vessel's center of mass which is used as the common reference for stabilizing all of the platforms. Secondary sensors at the respective platform locations sense localized motion due to pitch, roll, and variations from flexing of the vessel. A secondary controller processes the local motion variations with respect to the common reference to calculate adjustments required to stabilize the platform at that location. Other platforms are stabilized using the same common reference, in conjunction with their local motion information.

Providing a common reference for use at multiple platform form sites while sensing local platform motion, allows for real-time, accurate positioning of multiple platforms relative to one another and relative to the position and orientation of the vessel's center of mass.

Applicant's approach overcomes the disadvantage of known stabilization systems which (a) stabilize each platform with respect to a different reference thereby accumulating error over time, or (b) ignoring local platform motion causing platform-to-platform misalignment.

These and other features and advantage of the invention will be apparent to those skilled in the art from the following detailed description, taken together with the accompanying drawings.

DETAILED DESCRIPTION OF THE INVENTION

Applicant's invention stabilizes platforms on a moving vessel by adjusting the position of all platforms with respect to a common reference, suitably the vessel's center of mass position and orientation, while taking into account local platform motion. Primary sensors positioned about the vessel provide position information for slowly varying data, such as heading, to continuously update the common reference. A secondary controller processes the local motion information relative to the updated common reference, and stabilizes the multiple platforms so that they are aligned with respect to one another and with respect to the vessel.

Larger vessels are equipped with sensors in the hull that automatically and continuously provide information relating to the vessel's attitude, heading, and velocity in relation to the earth's rotation which are used for navigational purposes. For example, speed may be measured by using sensors which transmit acoustic energy and receive return energy of a different frequency and Global Positioning Satellite (GPS) information may be used to calculate the vessel's position relative to a group of satellites. The sensors provide the information relative to the vessel's center of mass.

Figure 1:
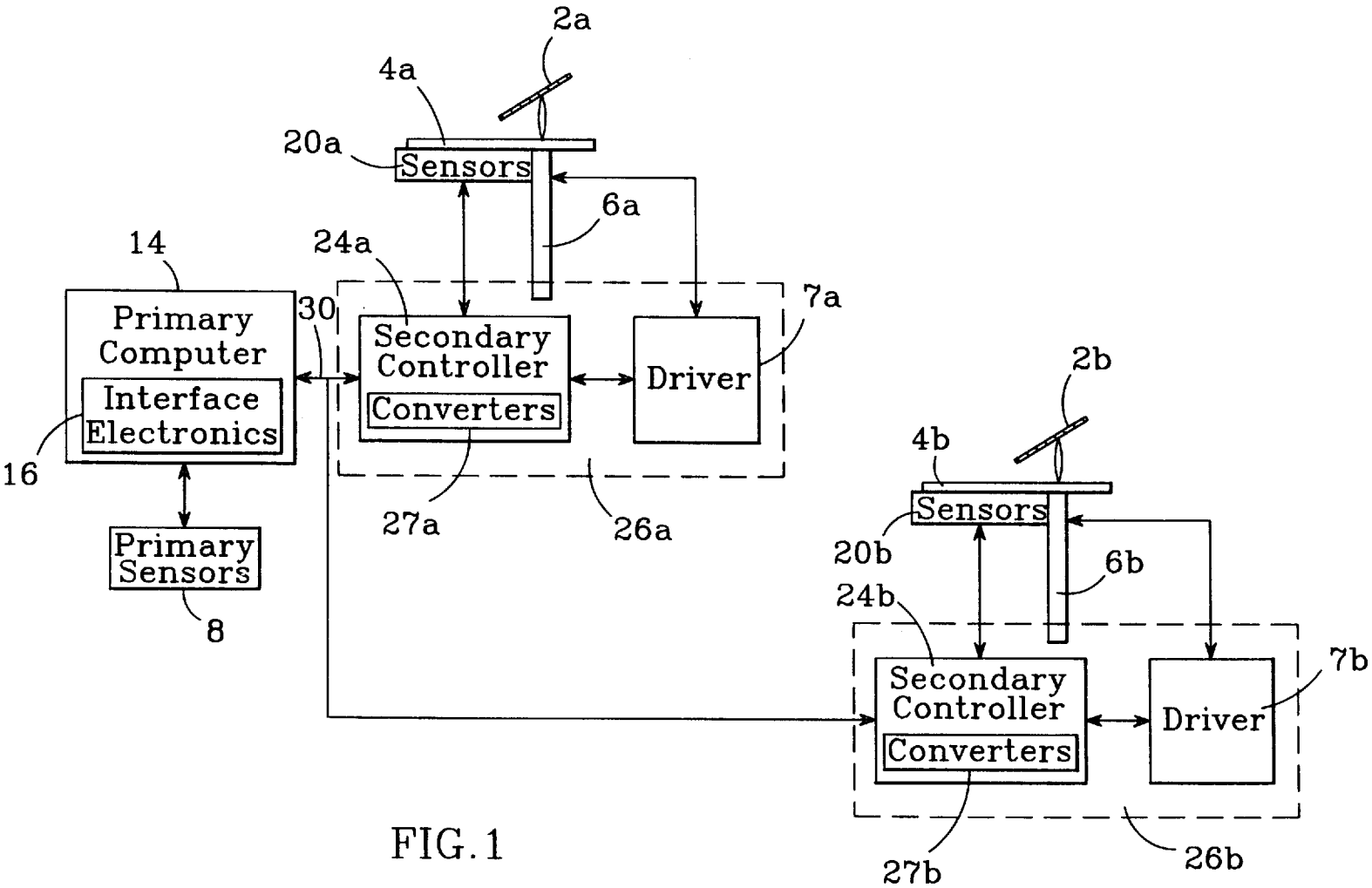
FIG. 1 is a block diagram of a system for stabilizing a plurality of platforms on a vessel in accordance with the invention.
Figure 2:
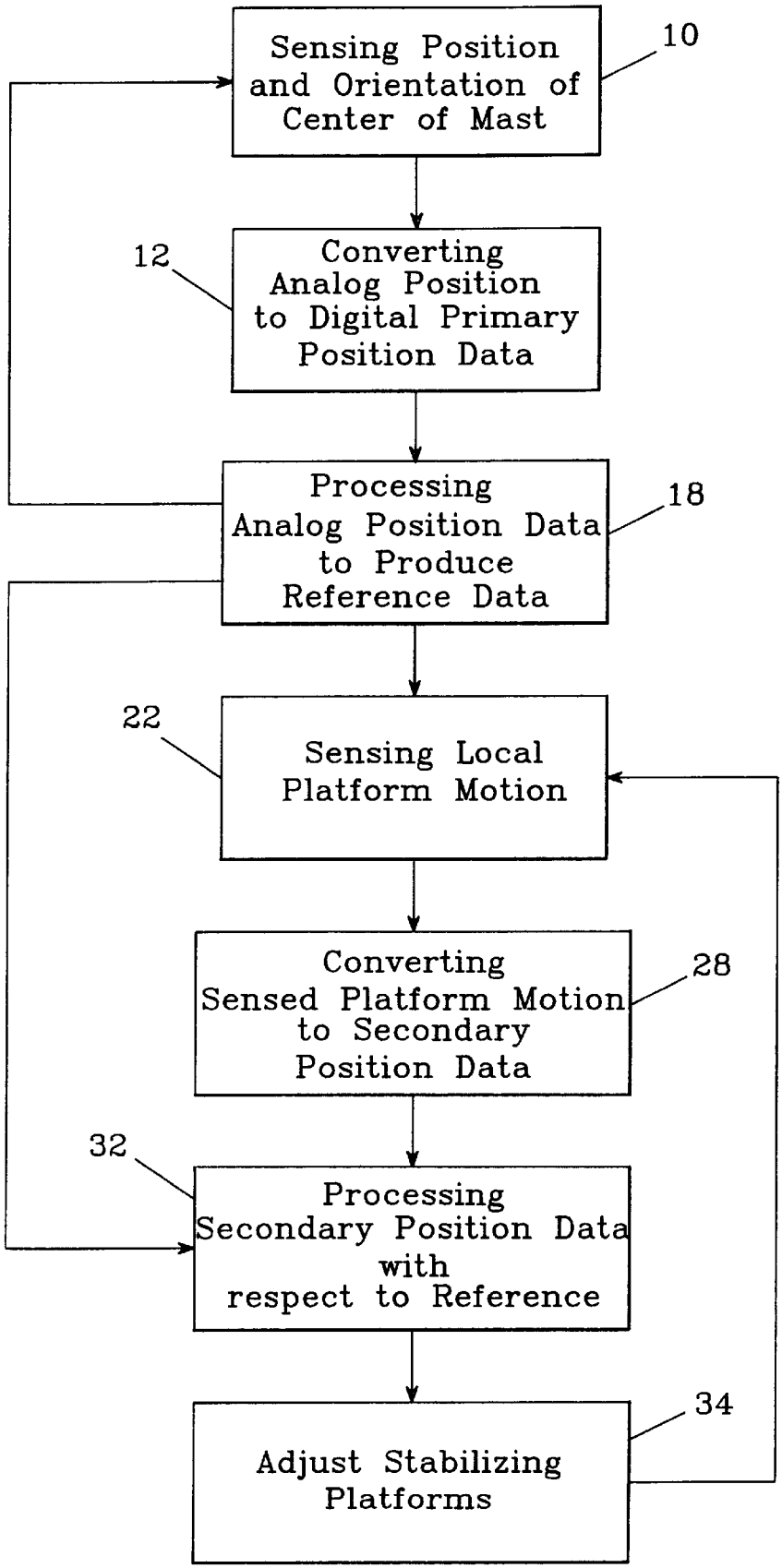
FIG. 2 is a flow diagram of a method of stabilizing multiple platforms on a vessel.

FIGS. 1 and 2 illustrate the new system and method for stabilizing antennas 2*a* and 2*b* on platforms 4*a* and 4*b*. The platforms 4*a* and 4*b* are mounted on stabilizing devices 6*a* and 6*b* such as gimbals or flexible ball joints, or utilize stepper motors, hydraulic or any number of other alternative devices which control movement. Drivers 7*a* and 7*b* control the movement of the stabilizing devices 6*a* and 6*b*. For example, if hydraulics are used to move the platform, the drivers 7*a* and 7*b* would apply power to the hydraulic motors for a period of time corresponding to the adjustment required. Likewise, if stepper motors are used, the driver feeds stepping pulses to the stepper motor. The number of pulses corresponds to the required adjustment.

Primary sensors 8 sense variations of the vessel's position with respect to its center of mass (step 10). Analog information is received from the primary sensors 8 and converted (step 12) to digital data by an onboard primary computer 14, which includes interface electronics 16 such as analog-to-digital converters, to produce primary position data. The sensors 8 may have interface electronics built into the sensor, in which case the digital data is extracted and used for processing. The primary computer 14 processes the primary position data, some of which may be redundant, averages it, and selects which information to use in determining the vessel's location, position and angle (step 18) to produce the common reference.

Secondary sensors 20*a* and 20*b* at the platform 4*a* and 4*b* locations, provide real time position information in response to local platform motion (step 22). This eliminates the need to calculate ahead in anticipation of position changes due to motion of the vessel. The sensor's outputs are fed to microprocessor based controllers 24*a* and 24*b* in secondary systems 26*a* and 26*b*, respectively. Controllers 24*a* and 24*b* include converters 27*a* and 27*b* for converting the sensor's analog outputs to digital data (step 28) to produce secondary position data.

The secondary controllers 24*a* and 24*b* interface with the primary computer 14 through a local or wide area network 30 to receive the updated common reference. Platform adjustments are calculated in real-time (step 32) using the local position information relative to the common reference. This compensates for platform variations due to localized motion while maintaining synchronization with other platforms distributed throughout the vessel. The position of platforms 4*a* and 4*b* are adjusted (step 34) by respective drivers 7*a* and 7*b* in accordance with the real-time calculations.

Using the vessel's center of mass position and orientation as a common reference eliminates the accumulation of positioning error that causes drifting over time. It also improves the accuracy of the adjustments required to stabilize the platform by providing a continuously updated common reference of the vessel's position and orientation. Since secondary motion data is available at the location of the platform being stabilized, errors due to the vessel flexing or time delays in transmission are reduced.

Figure 3:
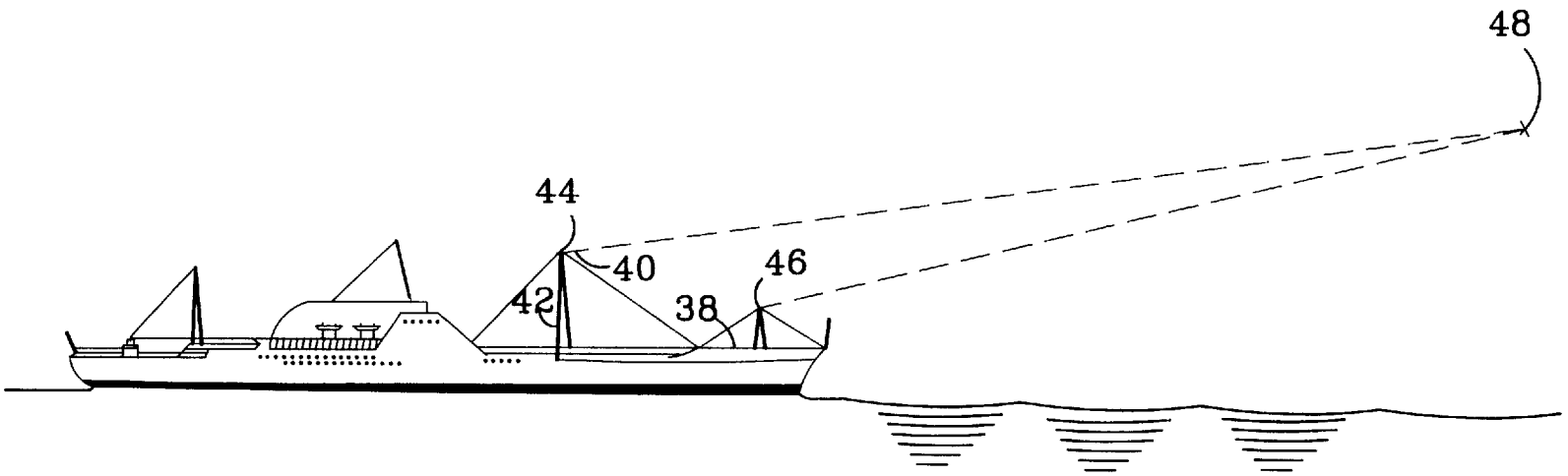
FIG. 3 is plan view of a vessel with two platforms tracking a common target.

FIG. 3 is a perspective view of a vessel 36 with two platforms 38 and 40, respectively. The first platform 38 is located on the forward section of the vessel 36 and a second platform 40 is located on the mast 42. Since the mast 42 has motion separate from the vessel 36, secondary sensors positioned on the second platform 40 provide real time position information for stabilization for the mast mounted platform 40. For the purpose of explanation, a radar antenna 44 is mounted on the second platform 40 while the first platform 38 stabilizes a weapon 46. The weapon operator relies on accurate target information from the radar antenna 44. This requires the two platforms 38 and 40 to be aligned relative to each other and relative to the actual vessel's 36 position and orientation. If the platforms were stabilized using only secondary sensor information, each platform would have accumulated errors introduced by using independent unstable references. By combining the common reference and local position motion, the new system stabilizes the two platforms 38 and 40, so that the pointing direction of the radar antenna 44 and the weapon 46 are synchronized, as shown by the dashed lines to ensure that they are tracking the same target 48.

The system configuration shown in FIG. 1 is illustrated for the purpose of explaining the method of stabilizing multiple platforms with respect to each other and with respect to a common reference. Although the system and method was described using the vessel's center of mass position and orientation as a reference, it is applicable to other common vessel references. Likewise, the configuration may be modified by using a different number of secondary controllers as well as by using alternative hardware to provide position information in response to motion of the vessel. For example, the secondary sensors may include sensors for monitoring vessel motions such as course and other parameters to provide redundancy. This would allow multiple platforms to track the horizon in the event of a communications failure over the area network. Alternative embodiments will occur to those skilled in the art. Such variations and alternatives are contemplated, and can be made without departing from the spirit and scope of the invention as defined in the appended claims.

I claim:

1. A system for stabilizing at least one adjustable platform on a vessel, comprising:

a plurality of primary sensors on said vessel that sense changes in said vessel's position and orientation and produce a common reference corresponding to said vessel's position and orientation, a plurality of secondary sensor at said at least one platform's respective location that sense motion of said at least one platform and produces respective secondary position data corresponding to the motion of said at least one platform, at least one computer on said vessel that processes said respective secondary position data relative to said common reference to calculate adjustments required to stabilize said at least one platform, and a respective plurality of stabilizing devices to adjust the position of said at least one adjustable platform using the calculated adjustments from said computer.

2. The stabilizing system of claim 1, wherein said at least one computer includes:

a primary computer that processes a primary position data from said primary sensors to determine said common reference, a network, and a controller that processes said secondary position data relative to said common reference to calculate adjustments to stabilize said at least one platform, said network connecting said primary computer to said controller.

3. The stabilizing system of claim 2, wherein said primary computer continuously updates said common reference and said controller processes said secondary position data relative to said updated common reference in real-time so that position errors do not accumulate.

4. The stabilizing system of claim 1, wherein said at least one computer continuously updates said common reference and processes said secondary position data relative to said updated common reference in real-time so that position errors do not accumulate.

5. A system for stabilizing a plurality of platforms on a moving vessel, comprising:

a plurality of primary sensors that sense a motion of said vessel and produce an output corresponding to said motion, an interface electronics which converts said sensor output to digital codes, a primary computer that processes said digital codes to update a common reference given by a position and orientation of said vessel's center of mass, a plurality of secondary sensors at the respective platforms that monitor their local motion and produce respective secondary position data, at least one controller that processes said secondary position data relative to said common reference to calculate respective platform adjustments required to level said plurality of platforms, a network connecting said primary computer to at least one controller to provide said common reference to said controller, and a respective plurality of motion controlling devices that adjust the position of said platforms corresponding to said platform adjustments.

6. The stabilizing system of claim 5, further including continuously updating said common reference and processing said respective secondary position data relative to said updated common reference in real-time to synchronize said plurality of platforms so that they track the same location.

7. A method of stabilizing a platform on a vessel, comprising the steps of:

sensing a primary motion of said vessel's position and orientation relative to earth to determine a common reference, sensing a local secondary motion at said platform onboard said vessel to produce a secondary position data, processing said secondary position data relative to said common reference to calculate an adjustment to compensate for motion of said vessel and said platform, and using said adjustments to stabilize said platform on said vessel.

8. The stabilizing method of claim 7, wherein said vessel has multiple platforms, said sensing a secondary motion further comprising:

sensing a first motion of a first platform, sensing a second motion of a second platform, converting said first and second sensed platform motions to respective platform position data, and adjusting the position of said first and second platforms to stabilize said platforms with respect to said common reference and said respective platform positions, wherein at least two of said multiple platforms track the same location.

9. The stabilizing method of claim 7, wherein said vessel has multiple platforms further including:

processing said vessel's position and orientation by a primary computer onboard said vessel to produce said common reference, continuously updating said common reference, sensing multiple local secondary motion at respective platforms on said vessel to produce respective secondary position data, calculating respective platform adjustment data from said respective secondary position data relative to said updated common reference by a controller onboard said vessel, and using said calculated respective platform adjustment data to stabilize said platforms in real-time so that said multiple platforms are synchronized.

10. A method of stabilizing a plurality of platforms on a moving vessel, comprising the steps of:

sensing a position and orientation of a reference point on said vessel, converting said sensed position and orientation to a primary position data, processing said primary position data by a primary computer onboard said vessel to produce a common reference data, continuously updating said common reference, sensing a respective plurality of secondary positions at respective locations of said platforms on said vessel, converting said sensed secondary positions to a respective plurality of secondary position data, processing said plurality of secondary position data relative to said updated common reference by at least one controller onboard said vessel to produce respective real-time position data, calculating respective platform position adjustments from said respective real-time position data by said at least one controller, and stabilizing said plurality of platforms with said respective calculated position adjustments to synchronize their alignment so that they track the same target.

* * * * *